US011236768B2

(12) United States Patent
Rolandson

(10) Patent No.: US 11,236,768 B2
(45) **Date of Patent: *Feb. 1, 2022**

(54) EXHAUST GAS RECIRCULATION COMPRESSOR INLET THERMAL SEPARATION SYSTEM

(71) Applicant: Volvo Car Corporation, Gothenburg (SE)

(72) Inventor: Ola Rolandson, Vänersnäs (SE)

(73) Assignee: Volvo Car Corporation, Gothenburg (SE)

( * ) Notice: Subject to any disclaimer, the term of this patent is extended or adjusted under 35 U.S.C. 154(b) by 0 days.

This patent is subject to a terminal disclaimer.

(21) Appl. No.: 17/012,245

(22) Filed: Sep. 4, 2020

(65) Prior Publication Data

US 2020/0400161 A1 Dec. 24, 2020

Related U.S. Application Data

(63) Continuation of application No. 16/217,191, filed on Dec. 12, 2018, now Pat. No. 10,767,659.

(51) Int. Cl.
*F04D 29/58* (2006.01)
*F04D 29/40* (2006.01)
(Continued)

(52) U.S. Cl.
CPC ..... *F04D 29/5853* (2013.01); *F02B 33/40* (2013.01); *F04D 17/10* (2013.01); *F04D 29/403* (2013.01)

(58) Field of Classification Search
CPC .... F04D 29/5853; F04D 29/403; F04D 17/10; F04D 29/4213; F05D 2220/40; F02M 26/04; F02M 26/18; F02M 26/19
(Continued)

(56) References Cited

U.S. PATENT DOCUMENTS 6,098,744 A 8/2000 Kawamura
7,624,575 B2 12/2009 Noelle et al.
(Continued)

FOREIGN PATENT DOCUMENTS

CN 103370510 A 10/2013
CN 103742302 A 4/2014
(Continued)

OTHER PUBLICATIONS

First Office Action issued in Chinese Application 201911256133.4.

*Primary Examiner* — Hoang M Nguyen
(74) *Attorney, Agent, or Firm* — Clements Bernard Walker; Christopher L. Bernard

(57) ABSTRACT

An exhaust gas recirculation (EGR) system that utilizes an insulated separation wall that separates the hot, humid EGR gas duct from the cool, dry inlet air duct in the upstream proximity of the compressor inlet of the associated turbocharger compressor. This insulated separation wall inhibits the condensation of water droplets and the formation of ice particles near the mixing point of the EGR gases and inlet air in the upstream proximity of the compressor inlet, such that the turbocharger compressor wheel, blades, and other components are not subsequently damaged by the condensed water droplets or formed ice particles. The added insulation in this cold sink area essentially thermally isolates the hot, humid EGR gas flow from the cool, dry inlet air flow until the actual mixing point of the flows.

20 Claims, 7 Drawing Sheets

(51) Int. Cl.
*F04D 17/10* (2006.01)
*F02B 33/40* (2006.01)

(58) Field of Classification Search
USPC ..... 60/605.2
See application file for complete search history.

(56) References Cited

U.S. PATENT DOCUMENTS

| | | | | |
|---|---|---|---|---|
| 10,767,659 | B2 * | 9/2020 | Rolandson | F04D 17/10 |
| 2012/0201655 | A1 * | 8/2012 | Kusakabe | F02M 26/29 415/116 |
| 2017/0138319 | A1 | 5/2017 | Zurlo et al. | |
| 2018/0135479 | A1 * | 5/2018 | Matsui | F01M 13/00 |

FOREIGN PATENT DOCUMENTS

| | | | |
|---|---|---|---|
| DE | 102014205187 | A1 | 10/2014 |
| GB | 2535996 | A | 9/2016 |

* cited by examiner

EXHAUST GAS RECIRCULATION COMPRESSOR INLET THERMAL SEPARATION SYSTEM

CROSS-REFERENCE TO RELATED APPLICATION

The present disclosure is a continuation of U.S. patent application Ser. No. 16/217,191, filed on Dec. 12, 2018, and entitled "EXHAUST GAS RECIRCULATION COMPRESSOR INLET THERMAL SEPARATION SYSTEM," the contents of which are incorporated in full by reference herein.

TECHNICAL FIELD

The present invention relates generally to the automotive field. More specifically, the present invention relates to an exhaust gas recirculation (EGR) compressor inlet thermal separation system configured to reduce the level of condensation in the exhaust gases recirculated to the associated turbocharger compressor inlet.

BACKGROUND

As fuel efficiency and emissions concerns become increasingly important, more and more vehicles are being equipped with turbochargers utilizing exhaust gas recirculation (EGR) systems. EGR systems increase the fuel efficiency of an internal combustion (IC) engine and reduce the emissions of noxious exhaust gases by recirculating a portion of the unused fuel and exhaust gases back to the engine for use, instead of releasing them into the environment. In a low pressure (LP) EGR system, the exhaust gases are reintroduced to the engine just upstream of the turbocharger compressor, at the turbocharger compressor inlet. At this location, the pressure is low, even under high engine boost conditions.

As illustrated in FIG. 1, EGR gases are mixed with conventional inlet air just before entering the turbocharger compressor. The ratio of EGR gases to inlet air determines the efficiency of the EGR system and engine overall. The utilization of EGR gases, however, is often limited by the condensation of water droplets in the EGR gases near the mixing point as the hot, humid EGR gases are cooled by the cool, dry inlet air. This cooling usually occurs through (and condensation usually occurs on and adjacent to) the wall that divides the hot, humid EGR gases from the cool, dry inlet air just prior to the mixing point, in the hot, humid EGR gases. This problem is especially pronounced under cold start and low temperature operating conditions, sometimes delaying the normal activation of the EGR system. This can compromise emissions testing results, for example, and otherwise degrade engine performance. In a worst case scenario, under extreme conditions, ice particles can even be formed in the EGR gases, exacerbating these issues.

Problematically, the condensed water droplets (or ice particles) near the mixing point of the EGR gases and the inlet air are fed directly to the turbocharger compressor. These water droplets (or ice particles) can impact the turbocharger compressor wheel, blades, and other components, damaging them. As illustrated in FIG. 2, the water droplets initially exert a force perpendicular to the component surface, which causes a blast wave upon component surface contact, resulting in a force exerted parallel to the component surface. This force exerted parallel to the component surface can impinge upon surface imperfections, causing spalls, cracks, etc. at or near such surface imperfections.

Thus, what is still needed in the art is an EGR system that inhibits the condensation of water droplets and the formation of ice particles near the mixing point of the associated EGR gases and inlet air, and especially on and adjacent to the wall separating the EGR gases from the inlet air, such that the subsequent turbocharger compressor wheel, blades, and other components are not damaged by the condensed water droplets or formed ice particles.

SUMMARY

The exhaust gas recirculation (EGR) system provided herein utilizes an insulated separation wall that separates the hot, humid EGR gas duct from the cool, dry inlet air duct in the upstream proximity of the compressor inlet of the associated turbocharger compressor. This insulated separation wall inhibits the condensation of water droplets and the formation of ice particles near the mixing point of the EGR gases and inlet air in the upstream proximity of the compressor inlet, such that the turbocharger compressor wheel, blades, and other components are not subsequently damaged by the condensed water droplets or formed ice particles. The added insulation in this cold sink area essentially thermally isolates the hot, humid EGR gas flow from the cool, dry inlet air flow until the actual mixing point of the flows.

The insulated separation wall of the ported shroud can include, for example, a conventional aluminum material incorporating a plurality of foam inserts, an added plastic or foam wall member filled with a gas, or a honeycomb structured wall encompassing a trapped gas. In all cases, it is important that the mixing of the EGR gases and inlet air beyond this insulated separation wall occurs as close to the turbocharger compressor as possible, again to inhibit the condensation of water droplets and the formation of ice particles in the compressor inlet. This mixing can even occur after the turbocharger compressor wheel, after the flows have achieved a more consistent temperature with compression.

In one exemplary embodiment, the exhaust gas recirculation (EGR) compressor inlet thermal separation system provided herein includes: an EGR gas duct configured to carry EGR gas to a compressor inlet area disposed adjacent to a compressor; an inlet air duct configured to carry inlet air to the compressor inlet area disposed adjacent to the compressor, wherein the EGR gas is relatively hotter and more humid than the inlet air; and an insulated separation wall disposed between the EGR gas duct and the inlet air duct adjacent to the compressor inlet area, wherein the insulated separation wall is operable for thermally insulating the EGR gas from the inlet air until the EGR gas is mixed with the inlet air in or after the compressor inlet area. The insulated separation wall includes one or more of a non-metallic material and a structure configured to trap a gas in one or more voids. Optionally, the insulated separation wall includes a composite, plastic, or foam material interspersed with a metallic material. Alternatively, the insulated separation wall includes a composite, plastic, or, foam material that defines one or more gas-filled voids. Alternatively, the insulated separation wall includes a honeycomb structured metallic material that defines one or more gas-filled voids. Alternatively, the insulated separation wall includes one or more of the non-metallic material and the structure configured to trap the gas in one or more voids coupled to a metallic wall.

In another exemplary embodiment, the vehicle provided herein includes: a turbocharger compressor; an exhaust gas recirculation (EGR) system coupled to the compressor; and an EGR compressor inlet thermal separation system coupled to the compressor, including: an EGR gas duct configured to carry EGR gas to a compressor inlet area disposed adjacent to a compressor; an inlet air duct configured to carry inlet air to the compressor inlet area disposed adjacent to the compressor, wherein the EGR gas is relatively hotter and more humid than the inlet air; and an insulated separation wall disposed between the EGR gas duct and the inlet air duct adjacent to the compressor inlet area, wherein the insulated separation wall is operable for thermally insulating the EGR gas from the inlet air until the EGR gas is mixed with the inlet air in or after the compressor inlet area. The insulated separation wall includes one or more of a non-metallic material and a structure configured to trap a gas in one or more voids. Optionally, the insulated separation wall includes a composite, plastic, or foam material interspersed with a metallic material. Alternatively, the insulated separation wall includes a composite, plastic, or, foam material that defines one or more gas-filled voids. Alternatively, the insulated separation wall includes a honeycomb structured metallic material that defines one or more gas-filled voids. Alternatively, the insulated separation wall includes one or more of the non-metallic material and the structure configured to trap the gas in one or more voids coupled to a metallic wall.

In a further exemplary embodiment, the exhaust gas recirculation (EGR) compressor inlet thermal separation method provided herein includes: delivering EGR gas to a compressor inlet area disposed adjacent to a compressor via an EGR gas duct; delivering inlet air to the compressor inlet area disposed adjacent to the compressor via an inlet air duct, wherein the EGR gas is relatively hotter and more humid than the inlet air; and thermally insulating a separation wall disposed between the EGR gas duct and the inlet air duct adjacent to the compressor inlet area to thermally insulate the EGR gas from the inlet air until the EGR gas is mixed with the inlet air in or after the compressor inlet area. Thermally insulating the separation wall disposed between the EGR gas duct and the inlet air duct adjacent to the compressor inlet area includes providing a separation wall including one or more of a non-metallic material and a structure configured to trap a gas in one or more voids.

BRIEF DESCRIPTION OF THE DRAWINGS

The present invention is illustrated and described herein with reference to the various drawings, in which like reference numbers are used to denote like system components/method steps, as appropriate, and in which.

DESCRIPTION OF EMBODIMENTS

Again, the exhaust gas recirculation (EGR) system provided herein utilizes an insulated separation wall that separates the hot, humid EGR gas duct from the cool, dry inlet air duct in the upstream proximity of the compressor inlet of the associated turbocharger compressor. This insulated separation wall inhibits the condensation of water droplets and the formation of ice particles near the mixing point of the EGR gases and inlet air in the upstream proximity of the compressor inlet, such that the turbocharger compressor wheel, blades, and other components are not subsequently damaged by the condensed water droplets or formed ice particles. The added insulation in this cold sink area essentially thermally isolates the hot, humid EGR gas flow from the cool, dry inlet air flow until the actual mixing point of the flows.

Figure 1:
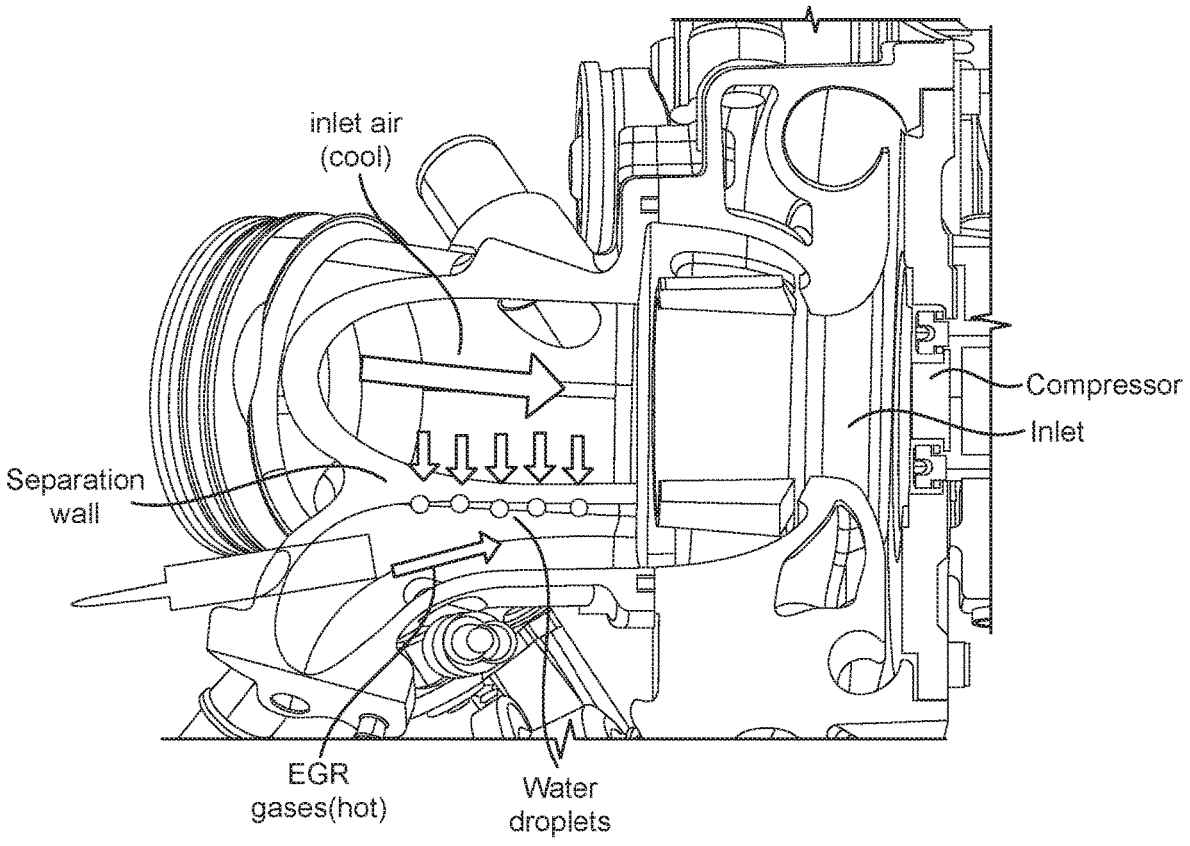
FIG. 1 (Prior Art)
FIG. 1 is a cut-away perspective view of a conventional ported shroud and compressor inlet area of an EGR system, highlighting the problematic condensation of water drop near the mixing point of the associated EGR gases and inlet air.
Figure 2:
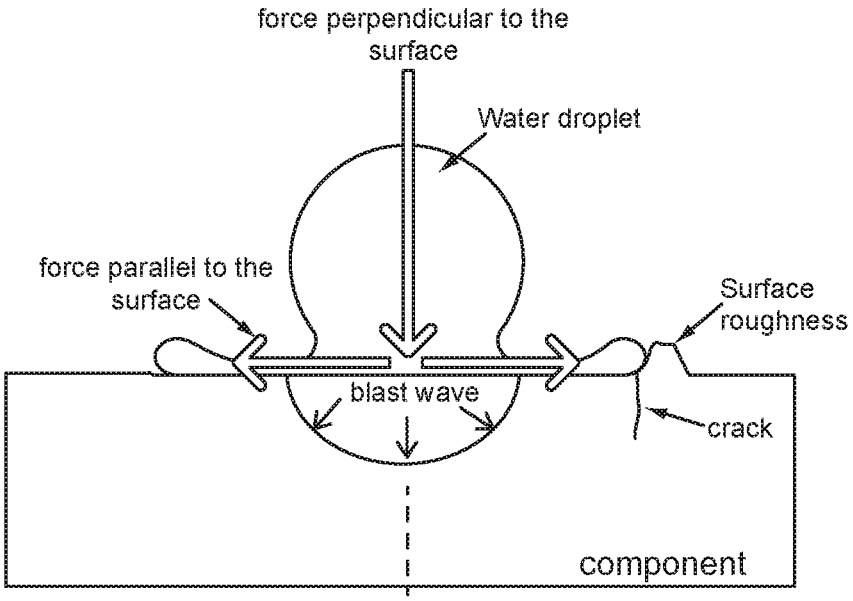
FIG. 2 (Prior Art)
FIG. 2 is a schematic diagram illustrating the mechanism by which condensed water droplets can damage a turbocharger compressor component.
Figure 3:
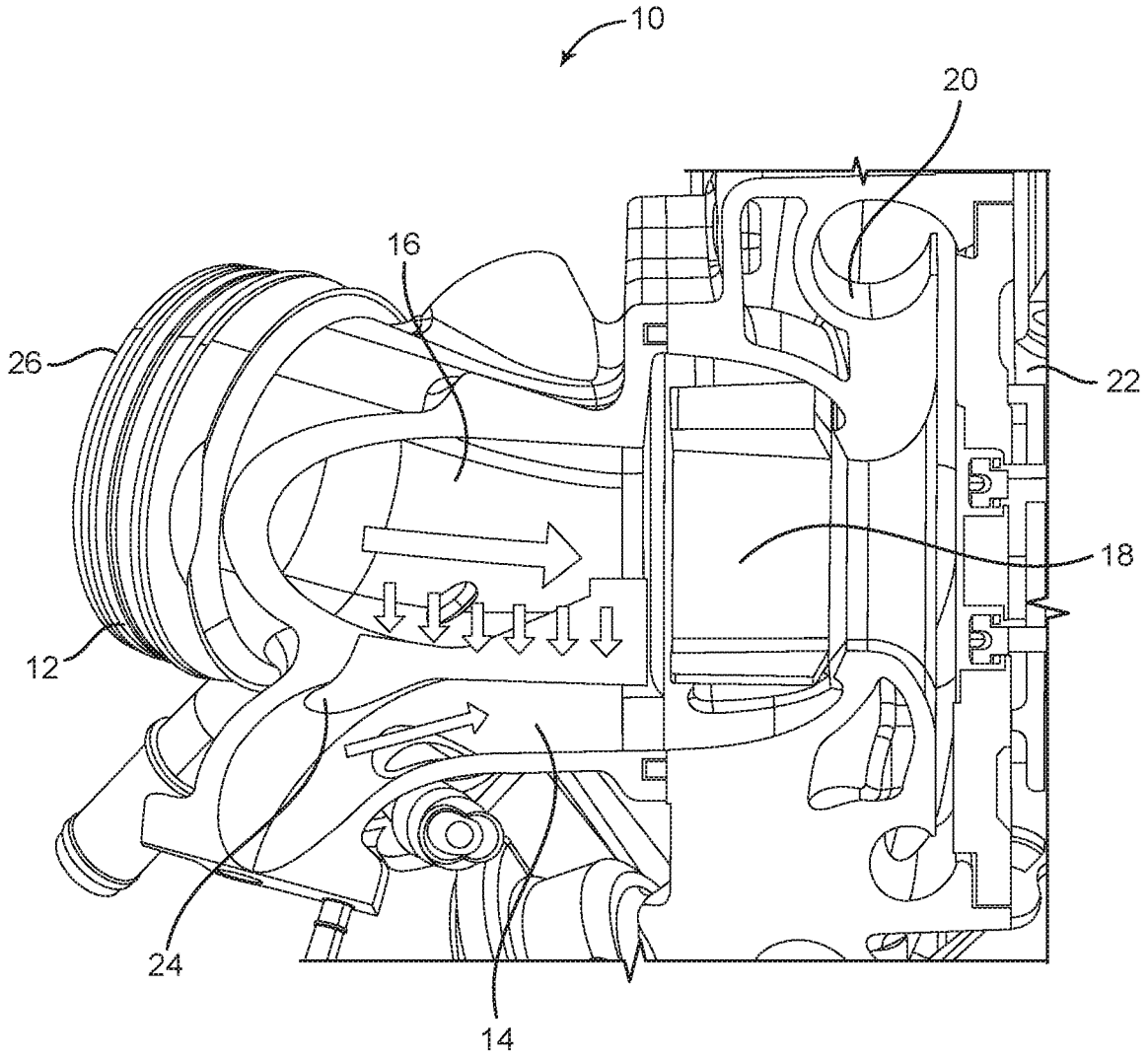
FIG. 3 is a cut-away perspective view of one exemplary embodiment of a ported shroud and compressor inlet area of an EGR system utilizing the insulated separation wall provided herein, the ported shroud in a partially installed configuration.
Figure 4:
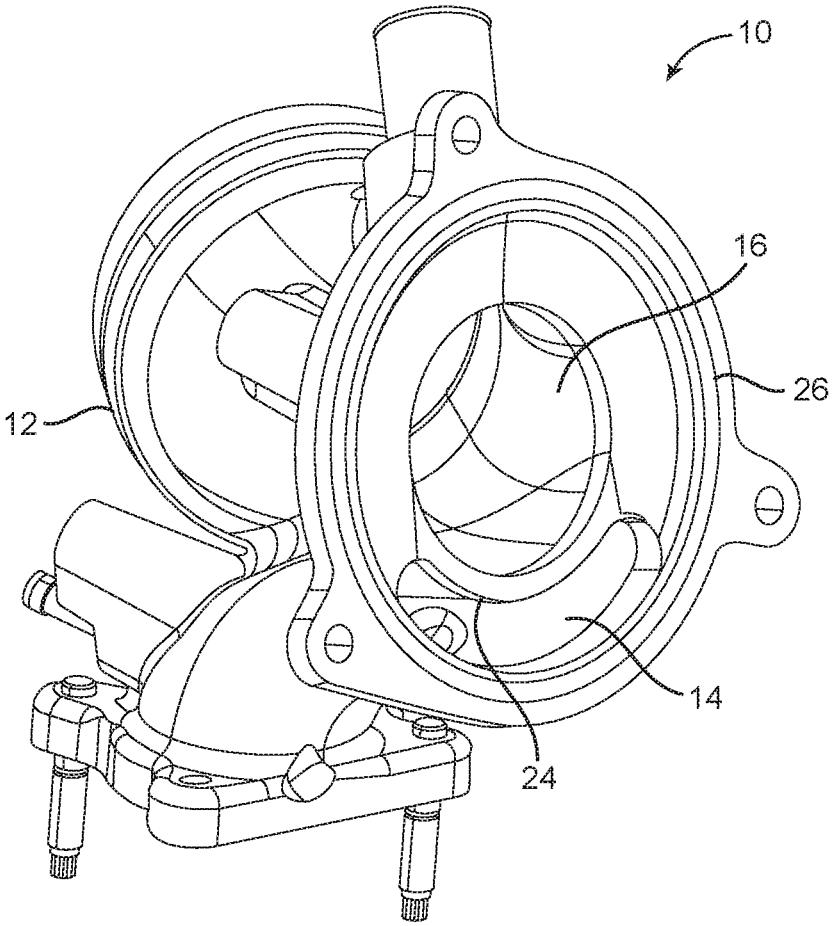
FIG. 4 is another perspective view of one exemplary embodiment of the ported shroud and compressor inlet area of the EGR system utilizing the insulated separation wall provided herein.
Figure 5:
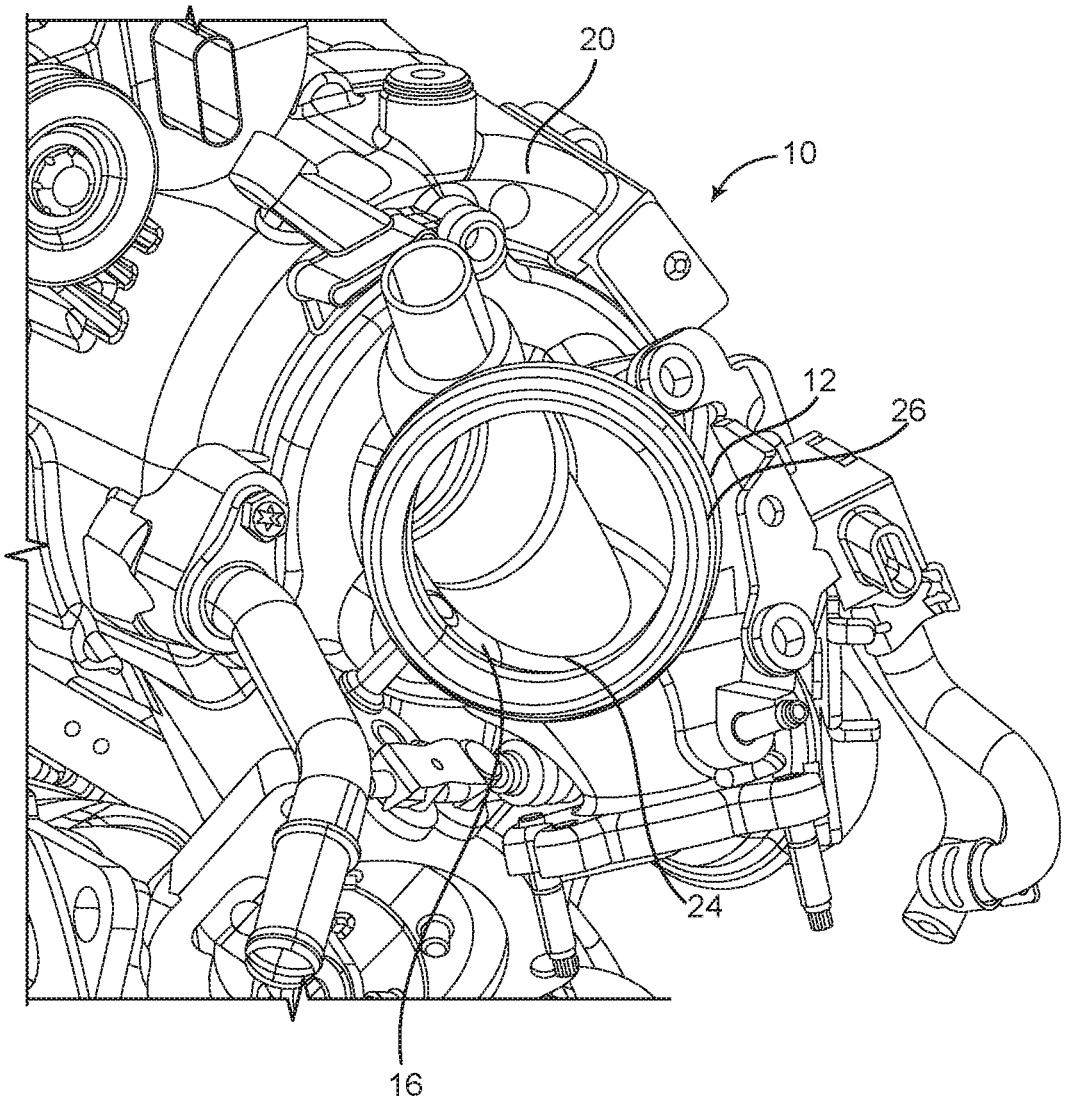
FIG. 5 is a further perspective view of one exemplary embodiment of the ported shroud and compressor inlet area of the EGR system utilizing the insulated separation wall provided herein, the ported shroud again in a partially installed configuration.
Figure 6:
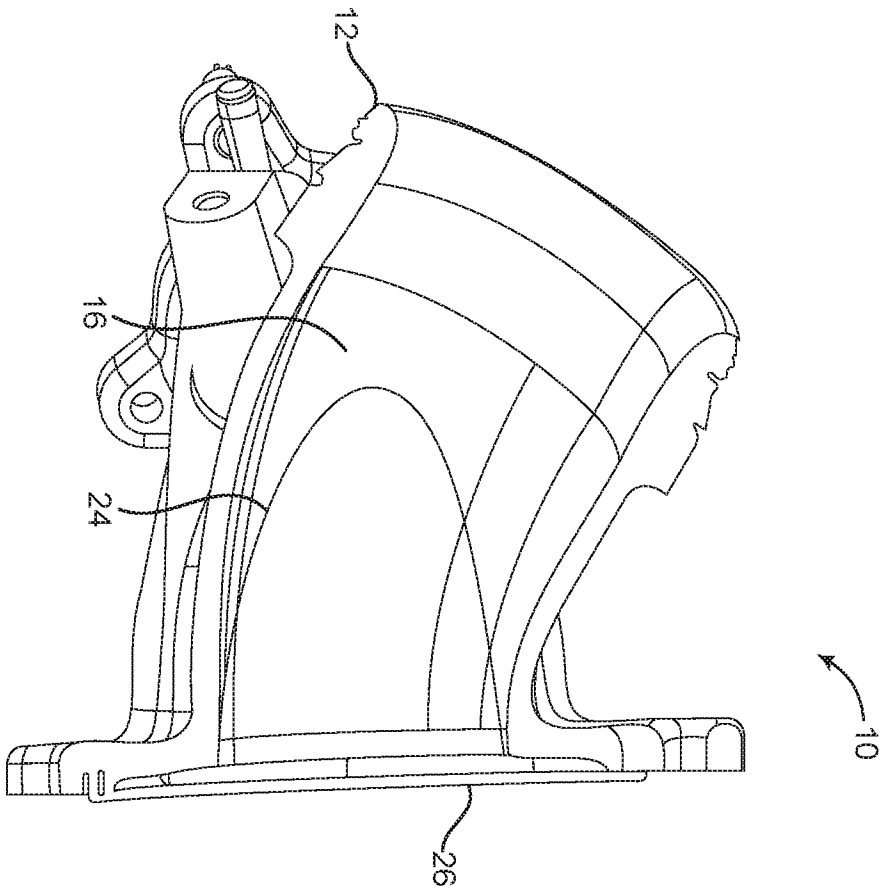
FIG. 6 is a still further perspective view of one exemplary embodiment of the ported shroud and compressor inlet area of the EGR system utilizing the insulated separation wall provided herein.
Figure 7:
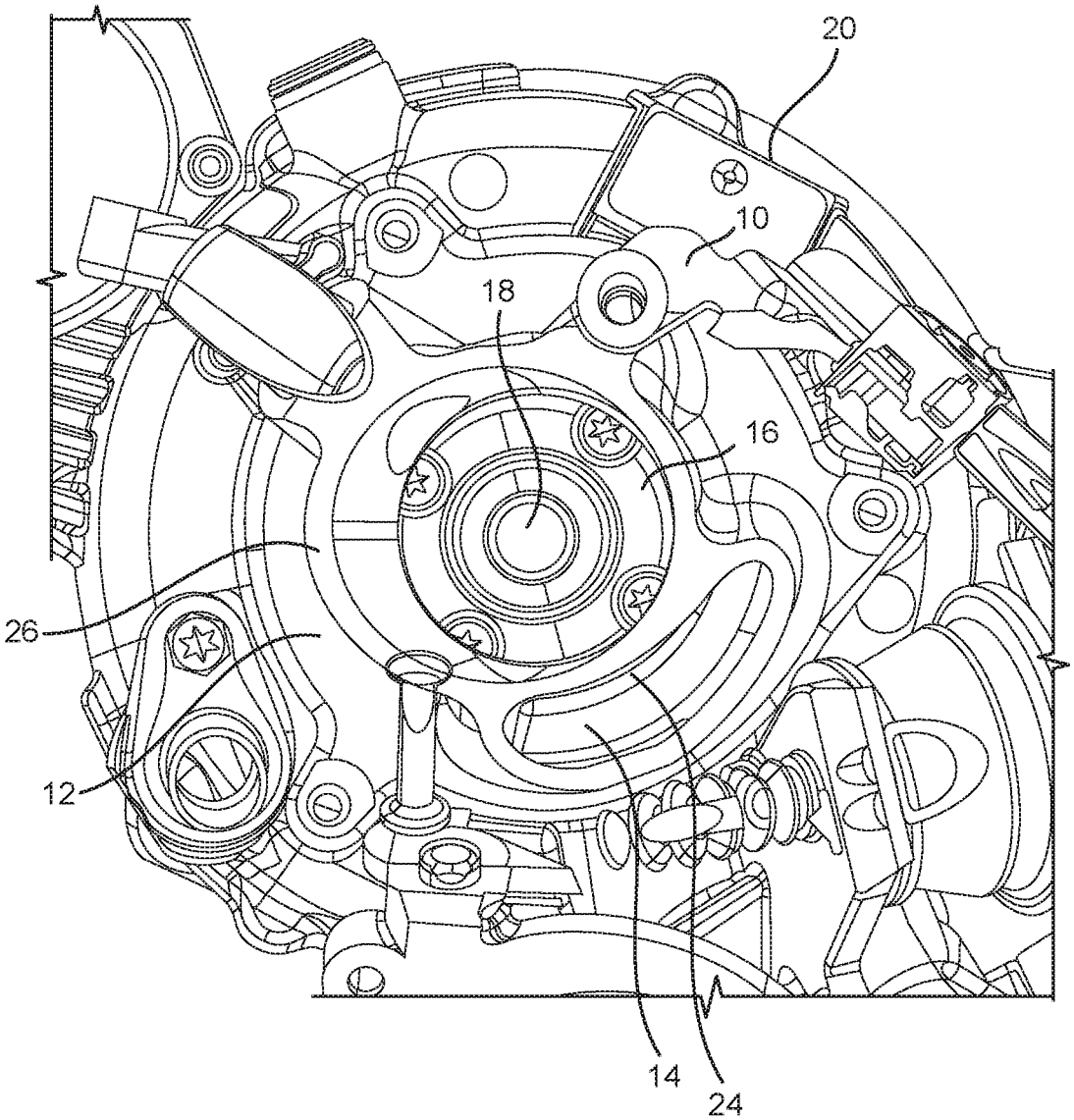
FIG. 7 is a still further perspective end view of one exemplary embodiment of the ported shroud and compressor inlet area of the EGR system utilizing the insulated separation wall provided herein, the ported shroud again in a partially installed configuration.

Referring now specifically to FIGS. 3-7, in one exemplary embodiment, the EGR thermal separation system 10 includes a ported shroud 12 that defines both an EGR gas duct 14 and an inlet air duct 16. The EGR gas duct 14 carries (low pressure (LP)) hot, humid EGR gas to a compressor inlet 18 that is minimally, partially, or wholly defined by the ported shroud 12. The inlet air duct carries cool, dry inlet air to the compressor inlet 18. The compressor inlet 18 can be partially or wholly defined by the compressor housing 20 upstream of the compressor 22, which includes a compressor wheel, compressor blades, and other compressor components, collectively operable for compressing the EGR gas and inlet air. The EGR gas and inlet air delivered to the compressor inlet 18 by the EGR gas duct 14 and the inlet air duct 16, respectively, are mixed together in the compressor inlet 18 upstream of the compressor 22, at the compressor 22 itself, or even after the compressor 22. In this exemplary embodiment, the ported shroud 12 is manufactured from a metallic material, such as an aluminum material. The inlet air duct 16 includes a cylindrical duct that essentially runs along the axis of rotation of the compressor wheel. The EGR gas duct 14 includes a flattened annular duct that runs along the bottom of the inlet air duct 16 and intersects the compressor inlet 18 at an angle to the axis of rotation of the compressor wheel. The final leg of the EGR gas duct 14 can be defined by the ported shroud 12 or by the compressor housing 20, depending on how the compressor inlet 18 is defined.

As described above, if a conventional aluminum wall is used to separate the EGR gas duct 14 from the inlet air duct 16, the cool, dry inlet air can cool the thermally conductive wall and cause the condensation of water droplets (or even the formation of ice) in the hot, humid EGR gas on or adjacent to the cool thermally conductive wall. This is problematic when these water droplets (or ice particles) are carried by the EGR gas, likely mixed with the inlet air, and run through the compressor 22. Compressor wheel, blade, and other component damage can result. The potential for this water droplet/ice formation is why mixing of the EGR gas and inlet air is typically delayed as long as possible.

To alleviate this problem, the ported shroud 12 instead uses a thermally insulated separation wall 24 to separate the EGR gas duct 14 from the air inlet duct 16, especially along the final leg of the ducts 14 and 16, where they are in close proximity. This thermally insulated separation wall 24 does not cool down significantly on the EGR gas duct side (or heat up significantly on the inlet air duct side). Thus, water droplets do not condense and ice particles do not form on the EGR gas duct side of the thermally insulated separation wall 24. Physical and thermal mixing of the EGR gas and inlet air is delayed until later in the compressor inlet 18, in the compressor 22 itself, or even after the compressor 22. Condensation/freezing is minimized or eliminated altogether.

In one exemplary embodiment, the thermally insulated separation wall 24 includes a simple plastic or foam insert that replaces or is coupled to the conventional separation wall. The plastic or foam insert can have a tongue-like shape and preferably conforms to the curves of the lower portion of the cylindrical inlet air duct 16 and the upper portion of the flattened annular EGR gas duct 14. The plastic or foam insert can be thinner proximate to the compressor inlet 18 and compressor 22 and thicker distant from the compressor inlet 18 and compressor 22. Optionally, the plastic or foam insert defines one or more hollow internal voids that are filled with another thermally insulating material or a gas to enhance the overall thermal insulation properties of the plastic or foam insert and the EGR thermal separation system 10.

In another exemplary embodiment, the thermally insulated separation wall 24 includes a plurality of smaller plastic or foam inserts that are disposed in slots or recesses manufactured into the conventional aluminum separation wall. Optionally, the plastic or foam inserts each define one or more hollow internal voids that are filled with another thermally insulating material or a gas to enhance the overall thermal insulation properties of the plastic or foam inserts and the EGR thermal separation system 10.

In a further exemplary embodiment, the thermally insulated separation wall 24 includes a honeycombed or other porous metallic (e.g., aluminum) or non-metallic structure. The honeycombed or other porous structure defines one or more hollow internal voids that are filled with another thermally insulating material or a gas to enhance the overall thermal insulation properties of the honeycombed or other porous structure and the EGR thermal separation system 10.

In general, the ported shroud 12, EGR gas duct 14, and inlet air duct 16 are all coupled to the surrounding conduits and structures via appropriate sealing surfaces incorporating gaskets, O-rings, or the like, as well as appropriate fastening devices or the like.

In another exemplary embodiment, the exhaust gas recirculation (EGR) compressor inlet thermal separation method provided herein includes delivering EGR gas to the compressor inlet area 18 disposed adjacent to the compressor 22 via the EGR gas duct 14 and delivering inlet air to the compressor inlet area 18 disposed adjacent to the compressor 22 via the inlet air duct 16. Again, the EGR gas is relatively hotter and more humid than the inlet air. As described above, if a conventional aluminum wall is used to separate the EGR gas duct 14 from the inlet air duct 16, the cool, dry inlet air can cool the thermally conductive wall and cause the condensation of water droplets (or even the formation of ice) in the hot, humid EGR gas on or adjacent to the cool thermally conductive wall. This is problematic when these water droplets (or ice particles) are carried by the EGR gas, likely mixed with the inlet air, and run through the compressor 22. Compressor wheel, blade, and other component damage can result. The potential for this water droplet/ice formation is why mixing of the EGR gas and inlet air is typically delayed as long as possible.

To alleviate this problem, the thermally insulating a separation wall 24 is disposed between the EGR gas duct 14 and the inlet air duct 16 adjacent to the compressor inlet area 18 to thermally insulate the EGR gas from the inlet air until the EGR gas is mixed with the inlet air in or after the compressor inlet area 18. In general, thermally insulating the separation wall 24 disposed between the EGR gas duct 14 and the inlet air duct 16 adjacent to the compressor inlet area 18 includes providing a separation wall 24 including one or more of a non-metallic material and a structure configured to trap a gas in one or more voids.

Thus, again, the exhaust gas recirculation (EGR) system provided herein utilizes an insulated separation wall that separates the hot, humid EGR gas duct from the cool, dry inlet air duct in the upstream proximity of the compressor inlet of the associated turbocharger compressor. This insulated separation wall inhibits the condensation of water droplets and the formation of ice particles near the mixing point of the EGR gases and inlet air in the upstream proximity of the compressor inlet, such that the turbocharger compressor wheel, blades, and other components are not subsequently damaged by the condensed water droplets or formed ice particles. The added insulation in this cold sink area essentially thermally isolates the hot, humid EGR gas flow from the cool, dry inlet air flow until the actual mixing point of the flows.

Although the present invention is illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the present invention, are contemplated thereby, and are intended to be covered by the following non-limiting claims for all purposes.

What is claimed is:

1. An exhaust gas recirculation (EGR) compressor inlet thermal separation system, comprising:

an EGR gas duct adapted to carry EGR gas to a compressor inlet area disposed adjacent to a compressor;

an inlet air duct adapted to carry inlet air to the compressor inlet area disposed adjacent to the compressor, wherein the EGR gas is relatively hotter and more humid than the inlet air; and an insulated separation wall disposed between the EGR gas duct and the inlet air duct adjacent to the compressor inlet area, wherein the insulated separation wall is adapted to thermally insulate the EGR gas from the inlet air until the EGR gas is mixed with the inlet air in or after the compressor inlet area;

wherein the EGR gas duct is disposed adjacent to the inlet air duct and intersects the compressor inlet area at an angle to the inlet air duct subsequent to the insulated separation wall.

2. The EGR compressor inlet thermal separation system of claim 1, further comprising a ported shroud structure in which the EGR gas duct, the inlet air duct, and the insulated separation wall are formed or disposed.

3. The EGR compressor inlet thermal separation system of claim 2, wherein the ported shroud structure partially or wholly defines the compressor inlet area.

4. The EGR compressor inlet thermal separation system of claim 1, wherein the insulated separation wall comprises one or more of a non-metallic material and a structure adapted to trap a gas in one or more voids.

5. The EGR compressor inlet thermal separation system of claim 4, wherein the insulated separation wall comprises a composite, plastic, or foam material interspersed with a metallic material.

6. The EGR compressor inlet thermal separation system of claim 4, wherein the insulated separation wall comprises a composite, plastic, or, foam material that defines one or more gas-filled voids.

7. The EGR compressor inlet thermal separation system of claim 4, wherein the insulated separation wall comprises a honeycomb structured metallic material that defines one or more gas-filled voids.

8. The EGR compressor inlet thermal separation system of claim 4, wherein the insulated separation wall comprises one or more of the non-metallic material and the structure adapted to trap the gas in one or more voids coupled to a metallic wall.

9. A vehicle, comprising:

a turbocharger compressor;

an exhaust gas recirculation (EGR) system coupled to the compressor; and an EGR compressor inlet thermal separation system coupled to the compressor, comprising:

an EGR gas duct adapted to carry EGR gas to a compressor inlet area disposed adjacent to a compressor;

an inlet air duct adapted to carry inlet air to the compressor inlet area disposed adjacent to the compressor, wherein the EGR gas is relatively hotter and more humid than the inlet air; and an insulated separation wall disposed between the EGR gas duct and the inlet air duct adjacent to the compressor inlet area, wherein the insulated separation wall is adapted to thermally insulate the EGR gas from the inlet air until the EGR gas is mixed with the inlet air in or after the compressor inlet area;

wherein the EGR gas duct is disposed adjacent to the inlet air duct and intersects the compressor inlet area at an angle to the inlet air duct subsequent to the insulated separation wall.

10. The vehicle of claim 9, wherein the EGR compressor inlet thermal separation system further comprises a ported shroud structure in which the EGR gas duct, the inlet air duct, and the insulated separation wall are formed or disposed.

11. The vehicle of claim 10, wherein the ported shroud structure partially or wholly defines the compressor inlet area.

12. The vehicle of claim 9, wherein the insulated separation wall comprises one or more of a non-metallic material and a structure adapted to trap a gas in one or more voids.

13. The vehicle of claim 12, wherein the insulated separation wall comprises a composite, plastic, or foam material interspersed with a metallic material.

14. The vehicle of claim 12, wherein the insulated separation wall comprises a composite, plastic, or, foam material that defines one or more gas-filled voids.

15. The vehicle of claim 12, wherein the insulated separation wall comprises a honeycomb structured metallic material that defines one or more gas-filled voids.

16. The vehicle of claim 12, wherein the insulated separation wall comprises one or more of the non-metallic material and the structure adapted to trap the gas in one or more voids coupled to a metallic wall.

17. An exhaust gas recirculation (EGR) compressor inlet thermal separation method, comprising:

delivering EGR gas to a compressor inlet area disposed adjacent to a compressor via an EGR gas duct;

delivering inlet air to the compressor inlet area disposed adjacent to the compressor via an inlet air duct, wherein the EGR gas is relatively hotter and more humid than the inlet air; and thermally insulating a separation wall disposed between the EGR gas duct and the inlet air duct adjacent to the compressor inlet area to thermally insulate the EGR gas from the inlet air until the EGR gas is mixed with the inlet air in or after the compressor inlet area; wherein the EGR gas duct is disposed adjacent to the inlet air duct and intersects the compressor inlet area at an angle to the inlet air duct subsequent to the insulated separation wall.

18. The EGR compressor inlet thermal separation method of claim 17, wherein thermally insulating the separation wall disposed between the EGR gas duct and the inlet air duct adjacent to the compressor inlet area comprises providing a separation wall comprising one or more of a non-metallic material and a structure configured to trap a gas in one or more voids.

19. The EGR compressor inlet thermal separation method of claim 17, wherein the EGR gas duct, the inlet air duct, and the insulated separation wall are formed or disposed in a ported shroud structure.

20. The EGR compressor inlet thermal separation method of claim 19, wherein the ported shroud structure partially or wholly defines the compressor inlet area.

* * * * *